US007481689B2

(12) United States Patent
Wiginton

(10) Patent No.: US 7,481,689 B2
(45) Date of Patent: Jan. 27, 2009

(54) REIN FOR SURFING

(76) Inventor: John R. Wiginton, 6921 N. 1st St., McAllen, TX (US) 78504

( * ) Notice: Subject to any disclaimer, the term of this patent is extended or adjusted under 35 U.S.C. 154(b) by 0 days.

(21) Appl. No.: 11/936,701

(22) Filed: Nov. 7, 2007

(65) Prior Publication Data

US 2008/0108260 A1 May 8, 2008

Related U.S. Application Data

(60) Provisional application No. 60/864,715, filed on Nov. 7, 2006.

(51) Int. Cl.
*B63B 1/00* (2006.01)

(52) U.S. Cl. ..... 441/75

(58) Field of Classification Search ..... 441/75
See application file for complete search history.

(56) References Cited

U.S. PATENT DOCUMENTS

| | | | | |
|---|---|---|---|---|
| 3,802,011 | A * | 4/1974 | Castagnola | 441/75 |
| 4,929,208 | A * | 5/1990 | Corica | 441/75 |
| 5,050,538 | A * | 9/1991 | Gurski, Jr. | 119/865 |
| 5,194,026 | A * | 3/1993 | Corwin et al. | 441/75 |
| 6,390,872 | B1 * | 5/2002 | Davis | 441/75 |

* cited by examiner

*Primary Examiner*—Stephen Avila
(74) *Attorney, Agent, or Firm*—Michael L. Greenberg, Esq.; Greenberg & Lieberman, LLC

(57) ABSTRACT

A strap, used as a surf rein, that can detachably connect to a surfboard and a surfer. The strap does not interfere with the surfer's method and maneuverability due to a sliding mechanism between the strap and the attachment device. The strap is available to the surfer to improve board-rider contact by pulling on the strap with one hand.

3 Claims, 7 Drawing Sheets

REIN FOR SURFING

CONTINUITY DATA

This is a non-provisional application of U.S. provisional patent application No. 60/864,715 filed on Nov. 7, 2006, and priority is claimed thereto.

FIELD OF THE INVENTION

The present invention relates to a detachable strap to be used by surfers during aerial maneuvers without interfering with the surfer's normal method.

BACKGROUND OF THE INVENTION

Surfing is an immensely popular sport with a very large following. Over the years, surfboard design has improved, giving surfers the ability to perform more complicated moves. Nowadays, surfers often attempt difficult maneuvers that actually send them airborne and make it very difficult for the surfer to stay on his or her board. There is a need for a device that assists a surfer in staying on the board during these difficult maneuvers, while still allowing the freedom of movement that is exceptionally important in the sport of surfing.

Devices currently exist that attempt to aid a surfer in maintaining board control during stunts, but none of them provide the convenience and ease of use that the present invention introduces. Many of these existing devices still require the surfer to expend energy and diverted attention to holding onto the board strap, creating a need for a less invasive and adaptable strap. The present invention satisfies the need as it introduces a unique sliding mechanism that enables the surfer to remain connected to the device while catching and riding a wave so that the surfer does not have to feel around for the device once already up on the board and riding a wave.

U.S. Pat. No. 4,929,208 issued to Corica describes a surfboard that has an elastic strap built into the board that is pulled on by a surfer in order to press his or her feet more firmly against the surfboard when doing aerial maneuvers. It differs from the present invention in that with Corica, the surfer must either keep hand contact with the device while preparing to stand up on the board, or reach down and find the strap when preparing to perform a difficult maneuver while riding the wave. This is just another step that a surfer has to address while also trying to successfully catch and ride a wave, and is quite detrimental. The present invention satisfies this aspect by introducing a device capable of securing the strap on an individual in such a way that does not interfere with the surfer's attempt to catch and ride a wave. In addition, U.S. Pat. No. 4,990,113 issued to Morrison describes a hand grip that can be adhesively mounted to a surfboard that the surfer can hold onto. It differs from the present invention for the same reasons mentioned above.

U.S. Pat. No. 6,007,394 issued to Kagan describes a retractable surfboard binding device that aims to improve a surfer's control on the board by binding a surfer's feet to the surfboard, requiring absolutely no use of a surfer's hands. It differs from the present invention because Kagan focuses on securing the surfer's feet as opposed to providing a strap that can be attached to the surfer's body or hand.

Thus, there remains a need for a device that can detachably connect to both a surfboard and a surfer in order to facilitate the surfer in maintaining control when performing difficult surfing maneuvers while not interfering with the surfer's normal method. In this manner, the present invention uniquely enables a surfer to ride without the often-tedious task of feeling his or her hands around the surfboard during a stunt in order to find a strap as is the case with existing devices. Existing methods and devices cause some amounts of detriment to the performance. The present invention, however, solves this problem with a flexible strap that uses tension and connection points to afford the surfer additional control and stability.

SUMMARY OF THE INVENTION

The present invention relates to a flexible strap that is to be attached to one end of a surfboard and at the other end is attached to the surfer. The strap is flexible and can be worn in a variety of ways by the surfer. The strap provides the surfer with additional control when performing complicated maneuvers on the surfboard by creating tension between the surfboard and surfer that aid the surfer in staying on the board. The surfer is able to attach the strap to his body using VELCRO™ patches or other connecting device that slide along the strap so that the surfer does not have to bend down and reach around to find the strap with his hand once the ride is initiated.

BRIEF DESCRIPTION OF DRAWINGS

The present invention will be better understood and objects other than those set forth above will become more apparent when consideration is given to the following detailed description thereof. Such description makes reference to the annexed drawings, wherein.

DETAILED DESCRIPTION OF THE INVENTION

The present invention is intended for use by anyone who uses a surfboard, and particularly by advanced surfers who use a surfboard to perform aerial maneuvers.

Figure 1:
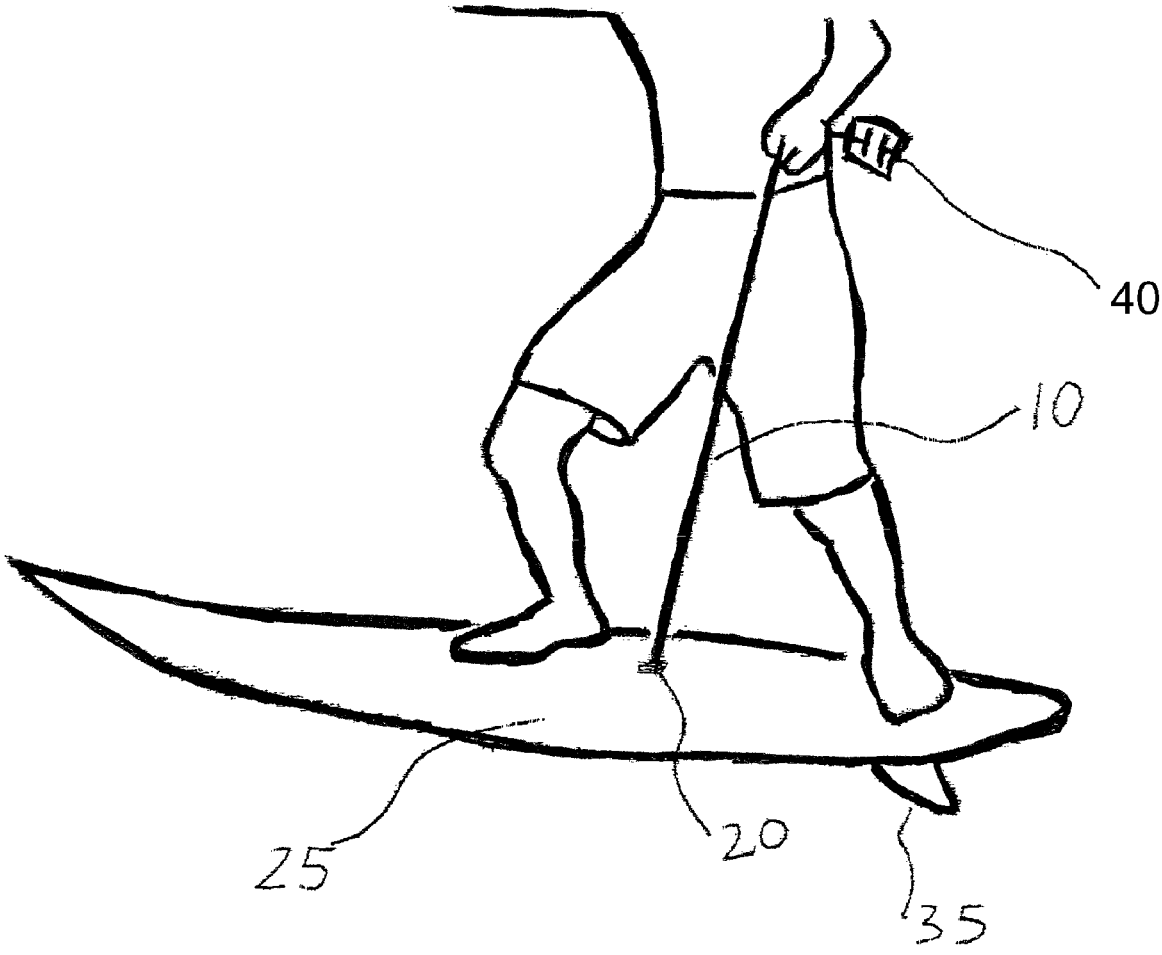
FIG. 1 is an environmental view of one embodiment of the present invention.

FIG. 1 illustrates a surfer using one embodiment of the present invention. The surfer is using the flexible strap (10) that is between 30 and 50 inches in length in order to improve his or her control on the surfboard. The flexible strap (10) can be manually pulled tight or loose by the surfer. This function of harnessing the tension related to the flexible strap (10) assists the surfer with control and stability during the act of surfing. This tension is most prominently useful during various surfing stunts.

Figure 2:
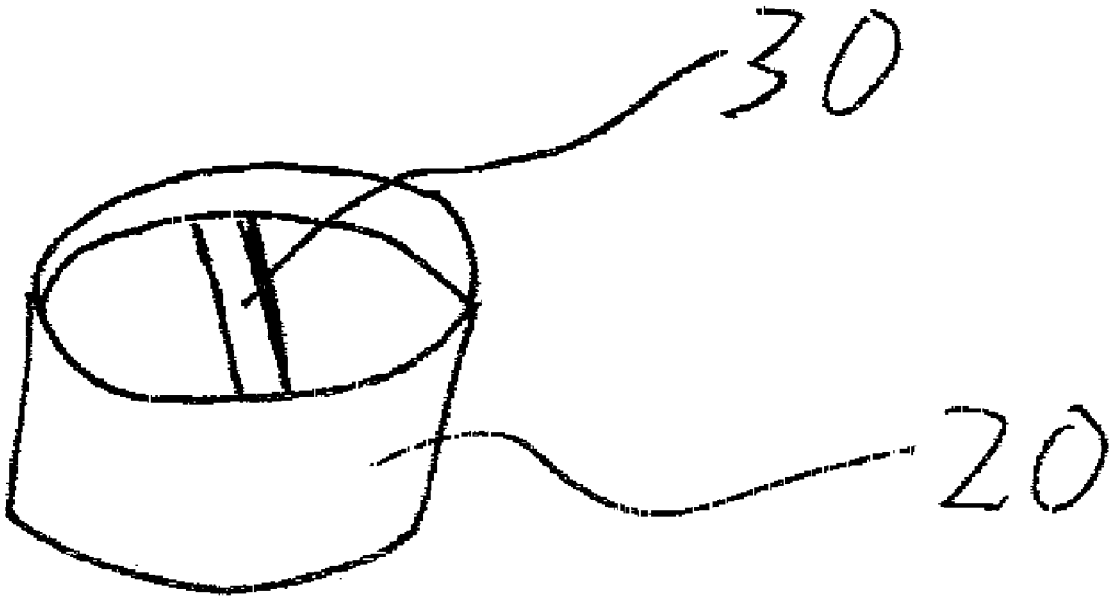
FIG. 2 is a view of the leash plug (20) and metal bar (30) of the present invention.
Figure 3:
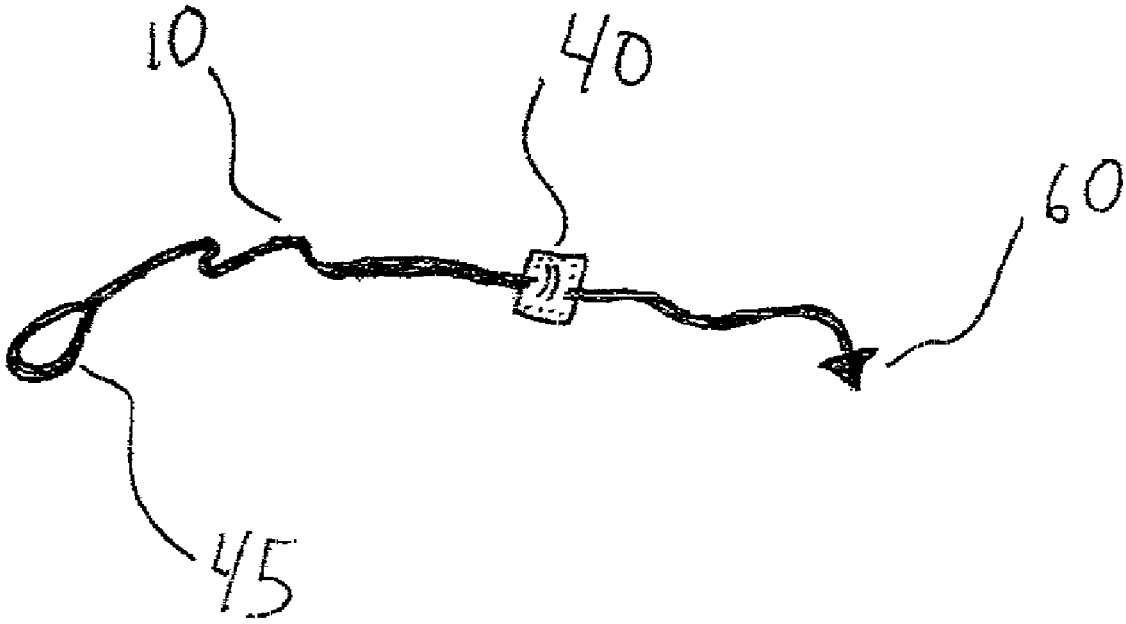
FIG. 3 is an embodiment of the present invention featuring a view of the flexible strap (10) with various components.

The flexible strap (10) is connected at one end to the surfboard via a leash plug (20) that is inserted into the deck (25) of the surfboard itself. The desired location of the leash plug (20) on the deck (25) of the surfboard is between 12 and 30 inches up from the forward-most fin (35), depending on the surfer's height and the length of the board, and such that it is located directly beneath the surfer, midway between his feet as he rides the wave. The leash plug (20) is preferably made of plastic and metal as is typical of current plug mounts for surfboard leashes. When permanently attached to the surfboard deck (25), the leash plug (20) should be centered on the surfboard such that the metal bar (30) as seen in FIG. 2 is oriented across the width of the surfboard to allow the strap to lay flat when the surfer lies on the board to paddle. The flexible strap (10) is tied at one end around the metal bar (30). A connection loop (45) as seen in FIG. 3 is used to physically tie the flexible strap (10) to the metal bar (30).

Figure 4:
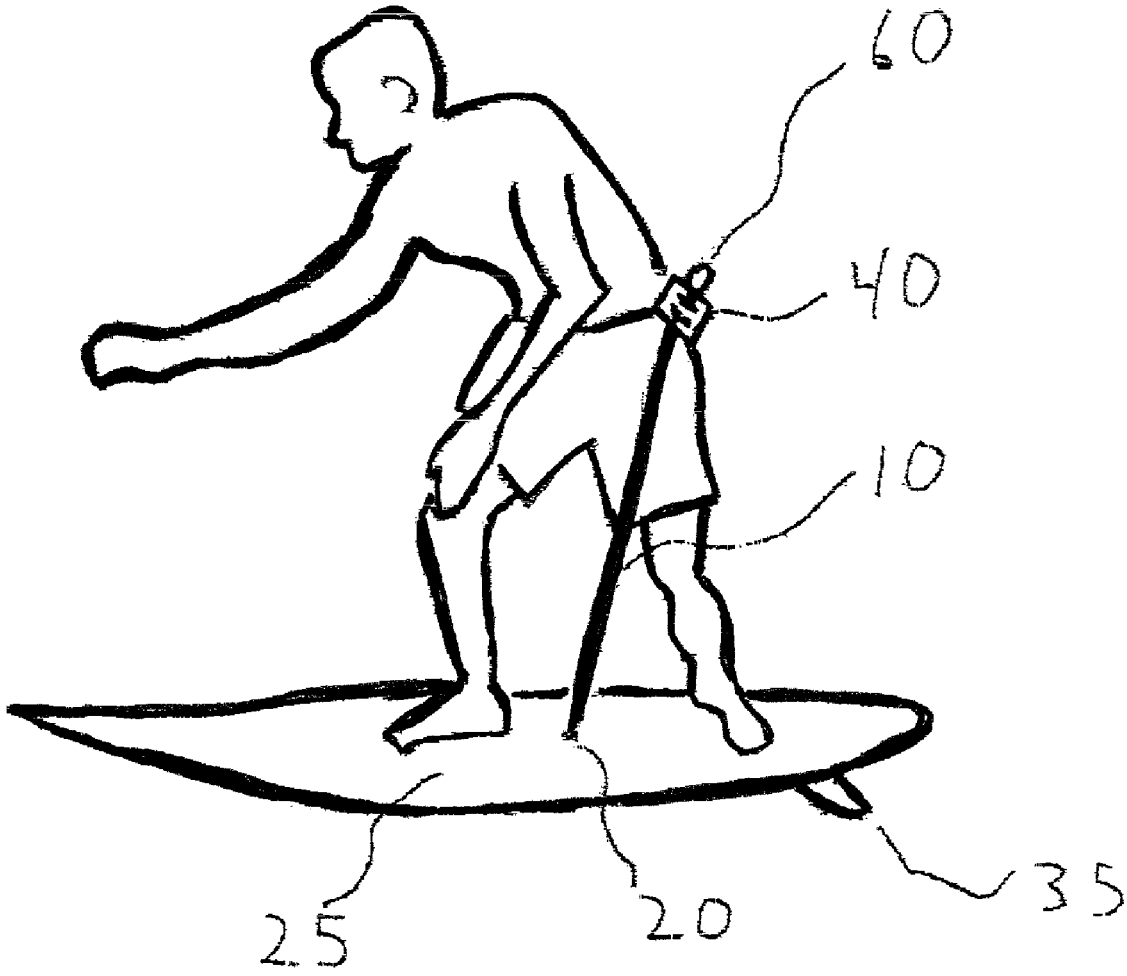
FIG. 4 is an environmental view of another embodiment of the present invention.

FIG. 4 illustrates a surfer using an alternate embodiment of the present invention than those aforementioned. The flexible strap (10) is again attached to the surfboard via the leash plug (20), but the surfer is now detachably connected to the other end of the flexible strap (10). The present invention includes a coarse patch (40) that is configured to slide onto the flexible strap (10), and the unattached end of the flexible strap (10) has a flared end (60).

Figure 5:
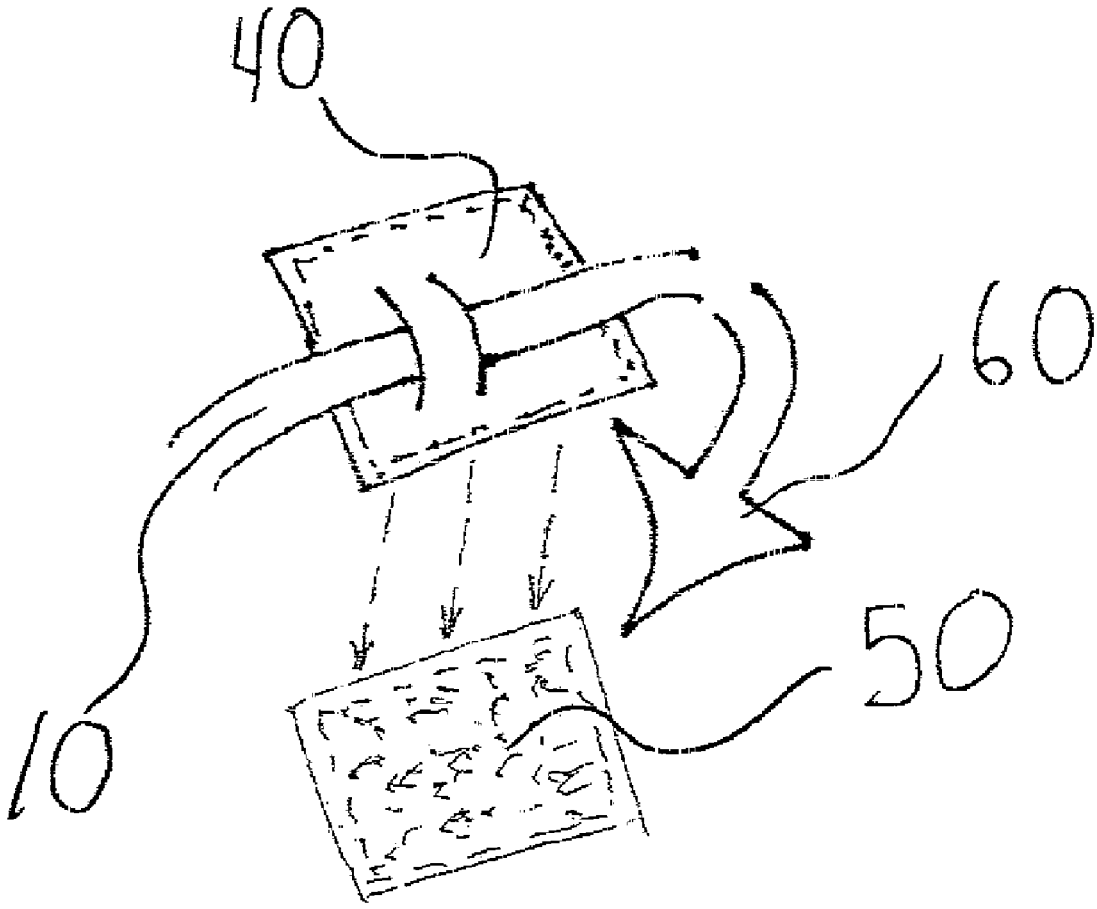
FIG. 5 is an embodiment of the present invention featuring a view of the connection mechanism.

In the preferred embodiment of the present invention, the coarse patch (40) may be made of a course connection such as VELCRO™. The coarse patch (40) is free to slide up and down the flexible strap (10), but cannot slide over the flared end (60) during use. A coarse patch (40) can be attached to a soft VELCRO™ patch (50), which in the embodiment displayed in FIG. 5 may be sewn into the surfer's swimwear so that the surfer can remain connected to the flexible strap (10) and the strap will remain in a position that provides ready access to the surfer's hands when desired. The significance of the coarse patch (40) is that a surfer can paddle to the desired location, and while sitting on the board can attach the coarse patch (40) to the soft patch (50) located on his or her body. When the surfer paddles into a wave and places his or her feet on the board, the surfer will not have to give thought to the flexible strap (10) because as the surfer starts to stand, the coarse patch (40) will slide along the flexible strap (10). When the surfer is in full standing position, the flexible strap (10) will be taut enough to remain accessible to the standing surfer's hands (i.e. not flapping around on the deck (25) of the board), but will not have so much tension that it breaks free from the soft patch (50). To further improve board-rider contact, an additional embodiment of the present invention features the surfer using one of his or her free hands in order to pull up on the strap, bringing the board closer to the body. A wipeout or fall from the board would, however, provide enough tension for the coarse patch (40) to separate from the soft patch (50) so that the surfer can safely distance himself from the surfboard after falling off and away from the surfboard. The overall patch mechanism of coarse patch (40) and soft patch (50) is designed to readily separate from the surfer and is not intended to be used to retrieve the surfboard after a wipeout.

Figure 6:
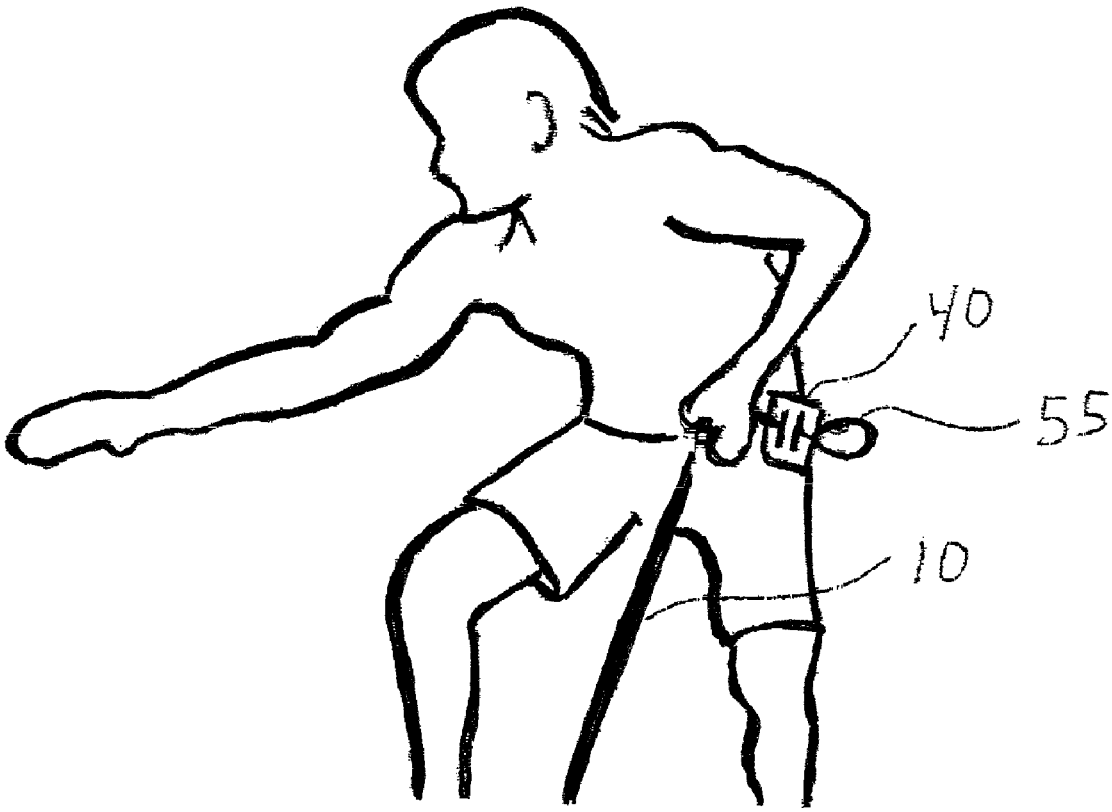
FIG. 6 is an environmental view of another embodiment of the present invention.

FIG. 6 illustrates a surfer using an alternate embodiment of the present invention than those aforementioned. The flexible strap (10) is again attached to the surfboard via the leash plug (20) and to the surfer via the coarse patch (40) and soft patch (50). However, the end of the flexible strap (10) that is not secured to the surfboard is now at a looping point (55) where it is looped around and attached to the coarse patch (40) to ensure that the coarse patch (40) does not slide off the end of the strap during use.

Figure 7:
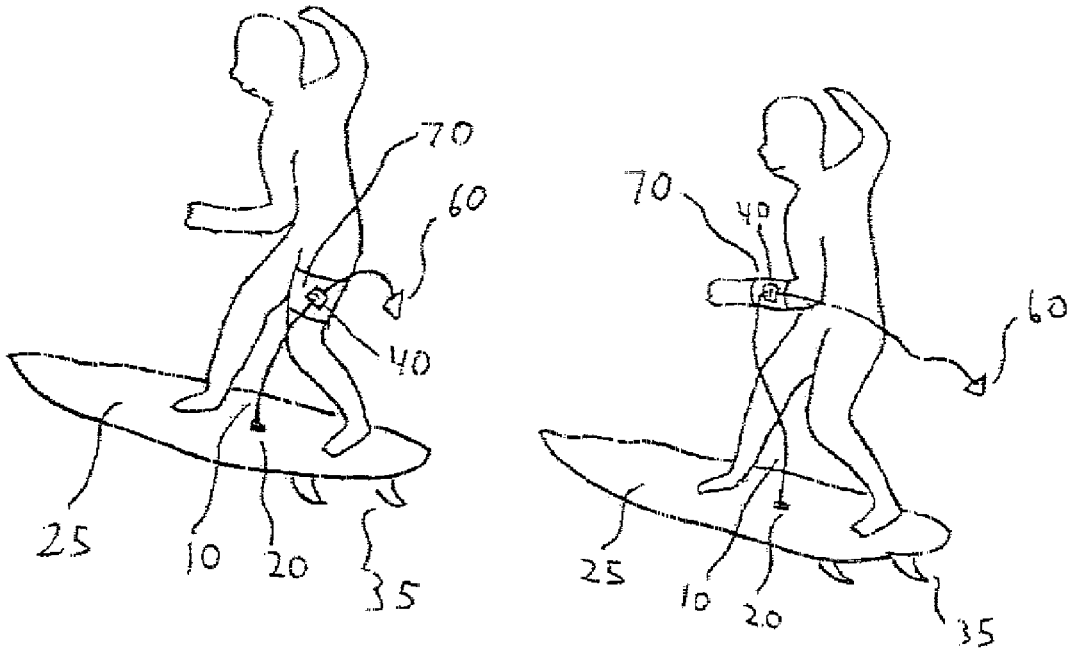
FIG. 7 is an environmental view of another embodiment of the present invention.

FIG. 7 is an additional embodiment of the present invention that features a surfer using the flexible strap (10) and is again attached to the surfboard via the leash plug (20) and to the surfer via the coarse patch (40) and soft patch (50). However, the soft patch (50) may be sewn into an elastic band (70) that is adjustable in size and can be secured to the surfer in various places, such as the leg, waist, or arm, rather than being secured to the surfer's swimwear.

An additional embodiment of the present invention employs a retractable mechanism comprised of conventional means that lets out the slack in the flexible strap (10) as the surfer stands up on the surfboard. This retractable mechanism would include a spring and spooling mechanism in the preferred embodiment of this additional embodiment, but other conventional means also would suffice.

Overall, the flexible strap (10) of the preferred embodiment of the present invention is originally behind the course patch (40) and soft patch (50). This helps in terms of the slack of the flexible strap (10) because when the surfer is sitting on the board, the flexible strap (10) is out of the way of the surfer so that he or she can paddle and catch a wave without any slack in the flexible strap (10) getting in the way. The surfer may then slide the flexible strap (10) through the use of the course patch (40) and soft patch (50) or other conventional sliding-type mechanism to effectively elongate or otherwise take up slack of the flexible strap (10) as the surfer stands to catch a wave.

It is to be understood that the present invention is not limited to the sole embodiment described above, but encompasses any and all embodiments within the scope of the following claims.

I claim:

1. A method for a surfer to surf with a rein, comprising:
- securing a bottom end of a flexible strap to a surfboard;
- securing the top end of the flexible strap to the surfer;
- pulling the flexible strap tight and loose;
- securing the bottom end of the flexible strap to the surfboard via a leash plug;
- inserting the leash plug into a deck of the surfboard;
- inserting the leash plug between 12 inches and 30 inches from a forward most fin of the surfboard;
- locating the leash plug midway between the feet of the surfer, the feet of the surfer positioned as they would be when the surfer is riding the surfboard;
- connecting the bottom end of the flexible strap to a bar located in the middle of the leash plug;
- orienting the bar across the width of the surfboard;
- connecting the bottom end of the flexible strap to the bar of the leash plug so that the bottom end of the flexible strap lays flat when the surfer lies on the surfboard to paddle;
- configuring all points of the flexible strap that are attached to the surfer to break away from the surfer upon the surfer falling when the flexible strap is in use during surfing;
- securing the top end of the flexible strap to the surfer using a sliding mechanism;
- removing the sliding mechanism;
- moving the sliding mechanism along the flexible strap as the upper body of the surfer moves farther or closer to the deck of the surfboard; and
- maintaining the flexible strap taut and accessible but with some slack when the surfer stands upright with the upper body of the surfer at a farthest point from the deck of the surfboard.

2. The method of claim 1, further comprising connecting only one point of attachment of the flexible strap to the surfer.

3. The method of claim 1, further comprising tightening the flexible strap when the surfer begins surging, the flexible strap being taut off of board deck without flapping, with the flexible strap having not too much tension so as to prevent from breaking free.

* * * * *